US011169479B2

(12) United States Patent
Burger et al.

(10) Patent No.: US 11,169,479 B2
(45) Date of Patent: Nov. 9, 2021

(54) MONITORING AND REPORTING TONER CARTRIDGE CAPACITY WITH SYNTHETIC TONER LEVEL VALUES TO PROVIDE FINER GRANULARITY

(71) Applicants: Steven Burger, Boulder, CO (US); Dan Piccoli, Boulder, CO (US); Keith D. Heasman, St. Jacobs (CA)

(72) Inventors: Steven Burger, Boulder, CO (US); Dan Piccoli, Boulder, CO (US); Keith D. Heasman, St. Jacobs (CA)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/805,225

(22) Filed: Feb. 28, 2020

(65) Prior Publication Data

US 2021/0271197 A1 Sep. 2, 2021

(51) Int. Cl.
*G03G 15/00* (2006.01)

(52) U.S. Cl.
CPC ..... *G03G 15/556* (2013.01); *G03G 15/5016* (2013.01); *G03G 15/5079* (2013.01); *G03G 2215/00109* (2013.01); *G03G 2215/0888* (2013.01)

(58) Field of Classification Search
None
See application file for complete search history.

(56) References Cited

U.S. PATENT DOCUMENTS

2005/0018230 A1* 1/2005 Green ..... G06K 15/12 358/1.13
2007/0177439 A1* 8/2007 Saito ..... B41J 3/46 365/190
2017/0102637 A1* 4/2017 Seto ..... G03G 21/1676

FOREIGN PATENT DOCUMENTS

JP 2013174650 A * 9/2013

OTHER PUBLICATIONS

JP_2013174650_A_T Machine Translation, 2013, Japan, Niikura (Year: 2013).*

* cited by examiner

*Primary Examiner* — Victor Verbitsky
(74) *Attorney, Agent, or Firm* — Hickman Becker Bingham Ledesma LLP; Edward A. Bekcer

(57) ABSTRACT

An approach is provided for monitoring and reporting capacity of a toner cartridge in a printing device. The printing device determines estimated toner levels based on actual toner levels obtained from a toner sensor of the printing device. The estimated toner levels are determined based on a first actual toner level and a second actual toner level obtained from the toner senor and print usage between the two actual toner levels. The estimated toner levels are determined for levels below the second actual toner level and are mapped to synthetic toner levels. Visual indications of the synthetic toner levels are displayed on the printing device.

20 Claims, 4 Drawing Sheets

MONITORING AND REPORTING TONER CARTRIDGE CAPACITY WITH SYNTHETIC TONER LEVEL VALUES TO PROVIDE FINER GRANULARITY

FIELD

This invention relates generally to monitoring and reporting capacity of a toner cartridge in a printing device.

BACKGROUND

The approaches described in this section are approaches that could be pursued, but not necessarily approaches that have been previously conceived or pursued. Therefore, unless otherwise indicated, the approaches described in this section may not be prior art to the claims in this application and are not admitted to be prior art by inclusion in this section.

Low toner alert on a printer causes users to replace toner cartridges when there is capacity for additional printing. In some cases, the capacity can be significant. For instance, if a cartridge is rated at 10,000 pages and the lower toner warning is set at 20%, there are still 2,000 pages that can be printed. Discarding a non-empty toner cartridge not only wastes money but also increases environmental impact.

SUMMARY

A printing device comprises a user interface configured to exchange information between one or more users and the printing device, a toner cartridge, and one or more print processes. The one or more print processes are configured to determine a current toner level of the toner cartridge, determine whether the current toner level of the toner cartridge is at a first threshold level, and in response to determining that the current toner level of the toner cartridge is at the first threshold level, monitor a print usage of the printing device until the current toner level of the toner cartridge is at a second threshold level that is below the first threshold level. The one or more print processes are further configured to, in response to the current toner level of the toner cartridge reaching the second threshold level, determine a first estimated toner level of the toner cartridge that is below the second threshold level based on the print usage, the first threshold level, and the second threshold level, and display a visual indication of the first estimated toner level of the toner cartridge on the user interface.

A computer-implemented method comprising determining a current toner level of the toner cartridge, determining whether the current toner level of the toner cartridge is at a first threshold level, and in response to determining that the current toner level of the toner cartridge is at the first threshold level, monitoring a print usage of the printing device until the current toner level of the toner cartridge is at a second threshold level that is below the first threshold level. The computer-implemented method further comprises, in response to the current toner level of the toner cartridge reaching the second threshold level, determining a first estimated toner level of the toner cartridge that is below the second threshold level based on the print usage, the first threshold level, and the second threshold level, and displaying a visual indication of the first estimated toner level of the toner cartridge on the user interface.

The aforementioned approaches may also be implemented by one or more computer-implemented processes and non-transitory computer-readable media that store instructions which, when processed by one or more processed, implement the approach.

BRIEF DESCRIPTION OF THE DRAWINGS

In the figures of the accompanying drawings like reference numerals refer to similar elements.

DETAILED DESCRIPTION

In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention. Various embodiments are described hereinafter in the following sections:

I. OVERVIEW

II. ARCHITECTURE OVERVIEW

III. MONITORING AND REPORTING TONER CARTRIDGE CAPACITY

IV. GRAPHICAL USER INTERFACE IMPLEMENTATIONS

V. IMPLEMENTATION EXAMPLES

I. Overview

An approach is provided for monitoring and reporting capacity of a toner cartridge in a printing device. According to the approach, a method is used to determine estimated toner levels based on actual toner levels obtained from a toner sensor of a printing device. The estimated toner levels are determined based on a first actual toner level and a second actual toner level obtained from the toner senor and print usage between the two actual toner levels. The estimated toner levels are determined for levels below the second actual toner level and are mapped to synthetic toner levels. Visual indications of the synthetic toner levels are displayed on the printing device. This approach provides finer granularity of toner level that is otherwise unavailable to users.

II. Architecture Overview

Figure 1:
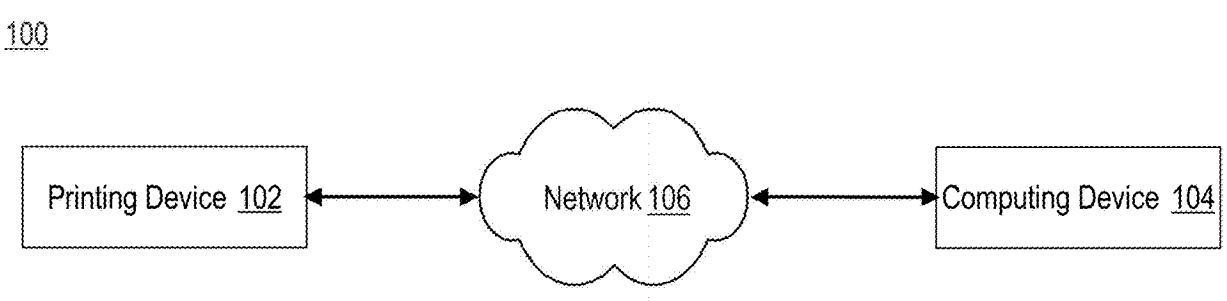
FIG. 1 is a block diagram that depicts an arrangement for monitoring and reporting capacity of a toner cartridge in a printing device, according to an embodiment.

FIG. 1 is a block diagram that depicts an arrangement 100 for monitoring and reporting capacity of a toner cartridge in a printing device, according to an embodiment. Arrangement 100 includes a printing device 102 and computing device 104. Computing device 104 may be remote from printing device 102 and may be communicatively coupled therewith via a network 106. Network 106 may be implemented with any type of medium and/or mechanism that facilitates the wired or wireless exchange of information between printing device 102 and computing device 104. Furthermore, network 106 may use any type of communications protocol and may be secured or unsecured, depending upon the requirements of a particular implementation. Printing device 102 and computing device 104 may also have direct communications links that are not depicted in the figures or described herein for purposes of brevity.

Computing device 104 may be implemented by any type of computing device. Example implementations of computing device 104 include, without limitation, workstations, personal computers, laptop computers, tablet computers, personal digital assistants (PDAs), cellular telephony devices and any type of mobile devices.

Computing device 104 may be configured with a management application that generates configuration data and communicates information, including configuration data, to and from printing device 102. Example configuration data include a notification threshold of a toner level to receive an electronic notification from printing device 102. Computing device 104 may be configured with other mechanisms, processes and functionality, depending upon a particular implementation, that are not depicted in the figures or described herein for purposes of brevity. In an embodiment, computing device 104 may be associated with a distributer/manufacturer and may be located at a distribution/manufacturing site.

Printing device 102 may be implemented by any type of device that is capable of processing print jobs and configuration using at least the configuration data received from computing device 104. Examples of printing device 102 include, without limitation, printers, copiers, multi-function peripherals (MFPs). An MFP is a device that performs one or more functions, such as printing, copying, facsimile and scanning.

Figure 2:
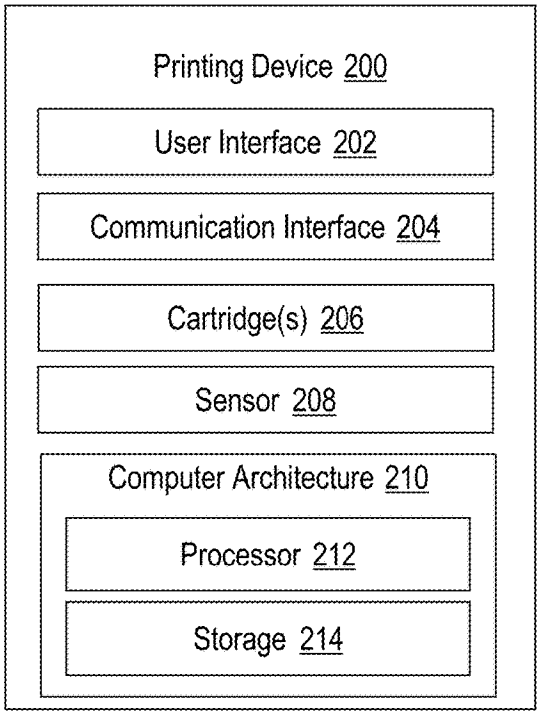
FIG. 2 is a block diagram that depicts an implementation of printing device, according to an embodiment.

FIG. 2 is a block diagram that depicts an implementation of printing device 200, according to an embodiment. In an embodiment, printing device 102 of FIG. 1 may be similarly configured as printing device 200. Printing device 200 includes a user interface 202, a communications interface 204, a toner cartridge 206, a toner sensor 208, and a computing architecture 210 that includes processor 212 and storage 214. Printing device 200 may include additional elements or fewer elements depending upon a particular implementation. Although embodiments are depicted in the figures and described herein in the context of a single toner cartridge 206, this is done for explanation purposes only and embodiments are applicable to any number of toner cartridges.

User interface 202 displays information to and/or receives user input from one or more users of printing device 200. User interface 202 may be implemented, for example, by a display and physical controls, such as a keyboard/keypad, a display and "soft" controls, such as graphical user interface controls, a touchscreen display, etc.

Communications interface 204 allows printing device 200 to communicate with other devices, such as computing device 104, via network 106 of FIG. 1 and/or directly, and may be implemented by one or more wireless and/or wired computer communications interfaces to support communications via Ethernet, Bluetooth, BLE, WiFi, WiGig, Near Field Communication (NFC), Infrared Data Association (IrDA), wireless USB, ZigBee, other Wireless Personal Area Network (WPAN) methodologies, etc.

Toner sensor 208 indicates when there is a specific, known level of toner in toner cartridge 206, such as 50% of toner remains. Known levels of toner in toner cartridge 206 may be in 10% increments or other increments depending on design specifications. According to an embodiment, toner cartridge 206 is a replaceable toner cartridge.

Computing architecture 210 includes processor 212 and storage 214, and supports the execution of computing processes and the storage of data, such as print jobs and configuration data, on printing device 102. Processor 212 may be one or more computer processors that are capable of executing instructions stored in storage 214. Instructions may receive toner level data (e.g., known toner level) for the toner cartridge 206 from toner sensor 208, track a number of printed pages for the toner cartridge 206, determine at least one estimated toner level based on the received toner level data, and map at least one estimated toner level to a synthetic toner level, and cause at least one synthetic toner level to be displayed on user interface 202. Storage 214 may be implemented by volatile storage, non-volatile storage, or any combination of volatile and non-volatile storage.

III. Monitoring and Reporting Toner Cartridge Capacity

According to one embodiment, an approach is provided for monitoring toner cartridge capacity. The approach maps an estimated toner level to a synthetic toner level. This is particularly useful in situations where printing devices display a default toner level once that toner level is reached and for each subsequent toner level. The synthetic toner level value may override the default toner level and may be displayed on printing device to provide finer granularity.

Figure 3A:
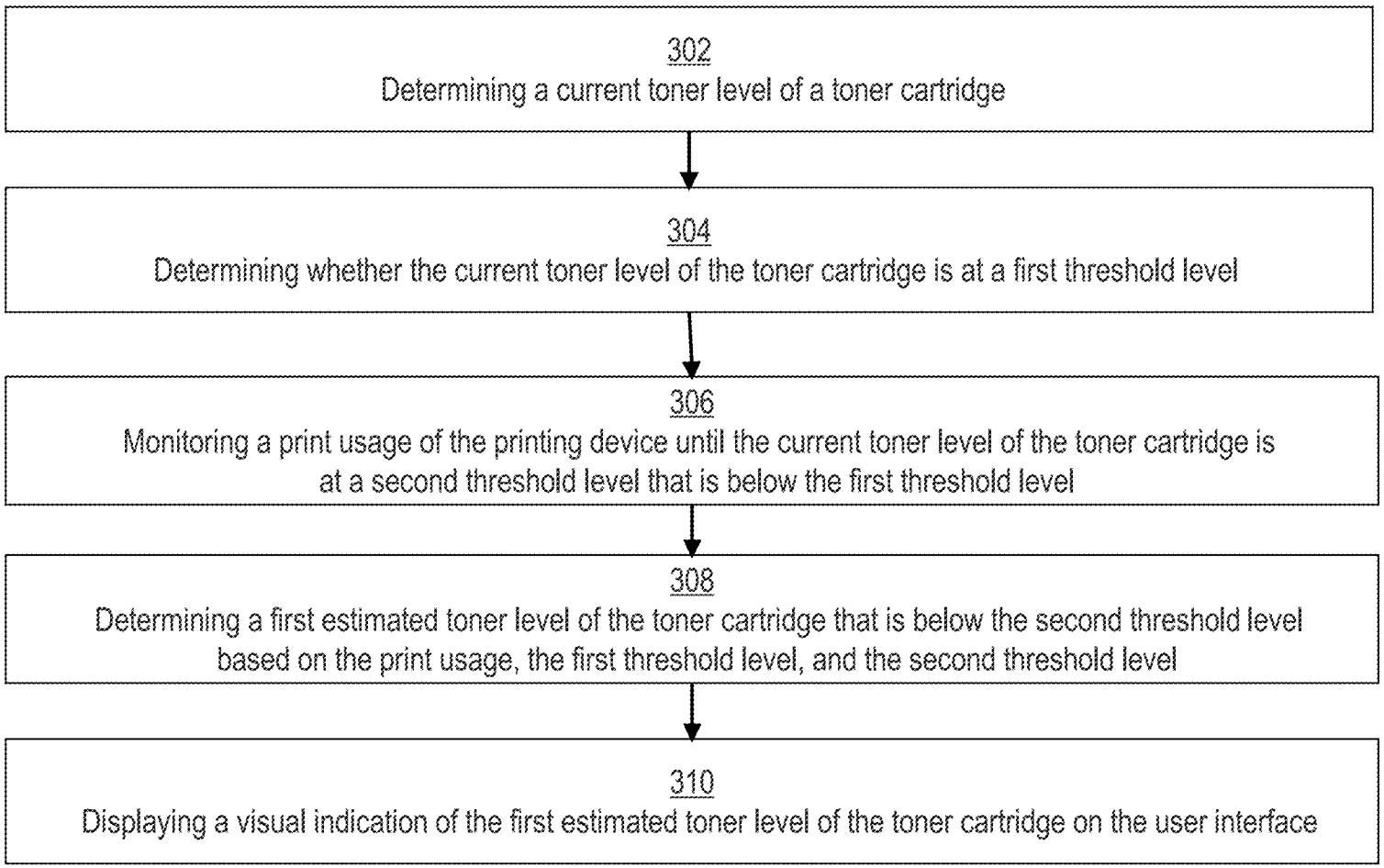
FIG. 3A is a method of monitoring and reporting capacity of a toner cartridge in a printing device, according to an embodiment.

FIG. 3A is a method 300 of monitoring and reporting capacity of a toner cartridge in a printing device, according to an embodiment. The method 300 is performed by one or more processes executing on the printing device. Although the method 300 depicted in FIG. 3 and described herein in the context of one toner cartridge in a printing device, the invention is not limited to this context and is applicable to each of any number of toner cartridges in the printing device.

In step 302, a current toner level of a toner cartridge in the printing device is determined. In an embodiment, the current toner level of the toner cartridge may be based on a sensed toner level of the toner cartridge by a toner sensor, according to specific, known levels of toner in the toner cartridge. The known levels of toner in the toner cartridge may be in increments of, for example, 10%.

In step 304, it is determined whether the current toner level of the toner cartridge is at a first threshold level. In step 306, in response to determining that the current toner level of the toner cartridge is at the first threshold level, print usage of the printing device is monitored until the current toner level of the toner cartridge is at a second threshold level that is below the first threshold value.

In an embodiment, the first and second threshold levels may correspond to percentages of toner remaining in the toner cartridge. For example, the first threshold level may be at 30% of toner cartridge capacity and the second threshold level may be at 20% of toner cartridge capacity. Other threshold levels are possible. In an embodiment, the first and second threshold levels may correspond to two consecutive known levels of toner in the toner cartridge, wherein subsequent levels after the second of the two consecutive known levels would otherwise be displayed at the second of the two consecutive known levels as a default toner level.

Print usage may relate to a number of pages printed, between the first threshold level and the second threshold level, using the toner cartridge. Alternatively, or in addition to, print usage may relate to a number of print jobs between the first threshold level and the second threshold level. Alternatively, or in addition to, print usage may relate a time period between the first threshold level and the second threshold level. Print usage may relate to other uses of the toner cartridge.

In response to determining that the current toner level of the toner cartridge is at the second threshold level, in step 308, an estimated toner level of the toner cartridge that is below the second threshold level is determined based on the print usage, the first threshold level, and the second threshold level. In step 310, a visual indication of the estimated toner level of the toner cartridge is displayed on a user interface of the printing device.

In step 308, a plurality of estimated toner levels of the toner cartridge that is below the second threshold level. The plurality of estimated toner levels may be mapped to a plurality of synthetic toner levels. Each of plurality of estimated toner levels may be in an increment of 1%. The plurality of estimated toner levels may include levels between the second threshold level and zero (0) (e.g., empty).

In an embodiment, the print usage between the first threshold level (e.g., 30%) and the second threshold level (e.g., 20%) may be used to determine an average number of pages per single toner level (e.g., 1%). The average number of pages may be used to generate a range of pages printed for each single toner level that is below the second threshold level. Each single toner level below the second threshold level is mapped to a synthetic toner level, which may be displayed in lieu of the default toner level (e.g., 20%) to provide finer granularity. The mapping may be configurable and may be according to one selected from a plurality of algorithms, based on print usage.

For example, assume 1000 (from 2000 to 3000) pages were printed between 30% and 20%. The average number of pages per single toner percent is 100 ((3000−2000)/10). For subsequent values below 20%, the range that applies to a single toner percent from 19% to 1% is in the range of 100 pages printed. Table 1 shows ranges of printed pages and estimated toner levels mapped to synthetic toner levels.

TABLE 1

| Range | Estimated Toner Level | Synthetic Toner Level |
|---|---|---|
| 3001-3100 | 19 | 20 |
| 3101-3200 | 18 | |
| 3201-3300 | 17 | |
| 3301-3400 | 16 | |
| 3401-3500 | 15 | |
| 3501-3600 | 14 | 10 |
| . . . | . . . | |
| ~ | ~ | |

Estimated toner levels 19 to 15 are mapped to synthetic toner level 20%, and estimated toner level 14 and below are mapped to synthetic toner level 10%. The ranges and synthetic toner levels associated with the estimated toner levels may vary and the foregoing are interpreted merely as an example.

In step 310, a visual indication corresponding to a synthetic toner level for an estimated toner level of the toner cartridge is displayed on the user interface of the printing device, when a number of pages printed is in a range associated the estimated toner level. For example, a visual indication corresponding to the synthetic toner level 20% is displayed when the number of pages that have printed using the toner cartridge is 3298. For another example, a visual indication corresponding to the synthetic toner level 10% is displayed when the number of pages that have printed using the toner cartridge is 3555.

In an embodiment, the visual indication may include one or more of a percentage of toner remaining (e.g., synthetic toner level) or a number of remaining pages that can be printed (which may be based on the average number of pages printed between the first threshold level and the second threshold level).

The method may further include performing subsequent calibration(s) to improve or verify accuracy of previously estimated toner levels. For example, a subsequent print usage of the printing device may be monitored between the first estimated toner level of the toner cartridge and a second estimated toner level of the toner cartridge that is below the first estimated toner level of the toner cartridge. Accuracy of a third estimated toner level, associated range and/or mapped synthetic toner level may be determined, based on the subsequent print usage, the first estimated toner level, and the second estimated toner level. Based on the determination, the third estimated toner level may be associated with a different range and/or mapped to different synthetic toner level.

The method may further include determining whether the current toner level is at a third threshold level that is below the second threshold level. A lock indicator for the toner cartridge may be displayed when the current toner level is not yet at the third threshold level and may not be displayed when the current toner level is at and below the third threshold level. The lock indicator visually indicates to users that the toner cartridge is "locked," which may or may not be physically locked, and does not yet have to be replaced. In an embodiment, the toner cartridge may be physically locked to prevent removal when the lock indicator is visually displayed and may be physically unlocked when the lock indicator is not visually displayed.

In an embodiment, the third threshold level may correspond to a percentage of toner remaining in the toner cartridge. For example, the third threshold level may be at 10% of toner cartridge capacity. Other threshold levels are possible. The third threshold level may correspond to the last known non-empty level of toner in the toner cartridge, or may correspond to one of the estimated toner levels of the toner cartridge. In an embodiment, the current toner level may be mapped a lower synthetic toner level, for example 5%, when the current toner level is at the last known non-empty level of toner in the toner cartridge.

In an embodiment, an electronic notification may be transmitted from the printer device to a remote device (e.g., computing device 104 of FIG. 1) via a network interface when the current toner level is at the third threshold level. The notification may inform distributer/manufacturer to take appropriate actions regarding the toner cartridge (e.g., schedule maintenance, ship a replacement toner cartridge, etc.). In an embodiment, a verification threshold level may be set by distributer/manufacturer using configuration data that is provided at least once to the printer device when an old toner cartridge is replaced, when the plurality of estimated toner levels is determined, and/or at other suitable times. In response to receiving the configuration data, the printer device configures the third threshold level based on the received configuration data.

IV. Graphical User Interface Implementations

Figure 3B:
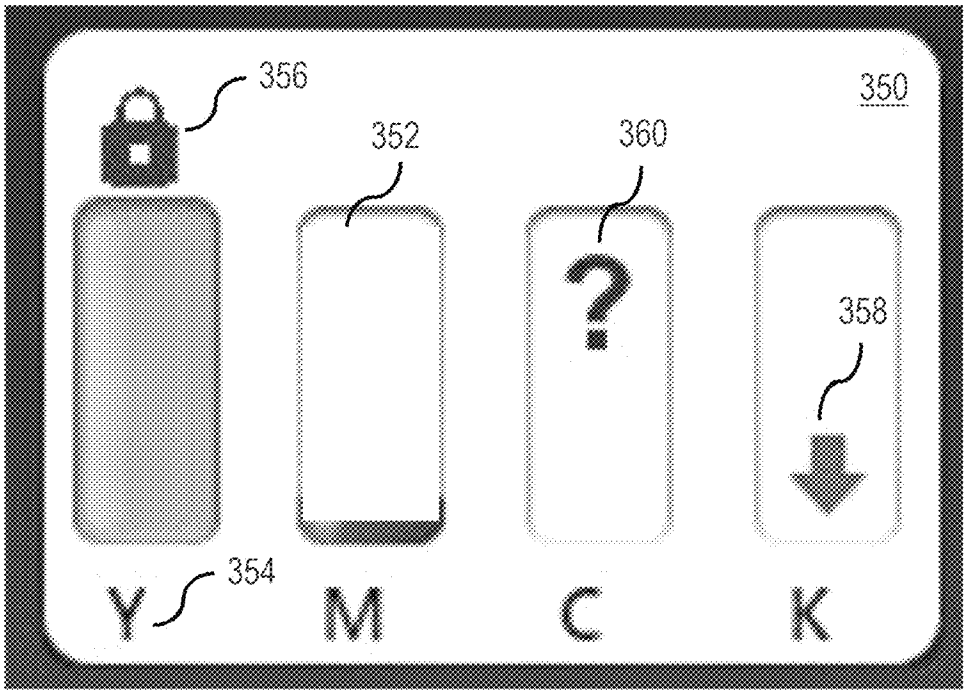
FIG. 3B is example graphical user interface display, according to an embodiment.

FIG. 3B is example graphical user interface display 350, according to an embodiment. The graphical user interface (GUI) display 350 includes a cylinder 352 representing each toner cartridge within a printing device, such as printing device 102 of FIG. 1. In FIG. 3B, four (4) cylinders 352 are shown, one for black (K), cyan (C), magenta (M), and yellow (Y). The cylinders 352 are aligned horizontally. A color indicator 354, such as a letter, is near each cylinder representing the cartridge color. An amount of shading of a cylinder represents an amount of toner remainder in a corresponding toner cartridge. Other visual indicators, such as a percentage of toner remaining and/or a number of remaining pages that can be printed, are contemplated. Depending on an amount of toner remaining in a toner cartridge, a lock indicator 356 is displayed above the cylinder corresponding to the toner cartridge. The lock indicator 356 indicates to users that the toner cartridge is "locked" since it does not yet have to be replaced. The toner cartridge may be soft locked (e.g., visual display of the lock indicator) and/or physically locked. When the toner cartridge is empty, the lock indicator 356 is not displayed but rather an arrow indicator 358 is displayed within the cylinder. The arrow indicator 358 indicates that the toner cartridge is unlocked and can be removed. Each cylinder may be shaded according to the synthetic toner level of the cartridge corresponding to the cylinder. An empty cylinder (e.g., not shaded) with a question mark indicator 360 is displayed when toner remaining cannot be obtained or calculated, no physical toner cartridge is present in the printing device, or an unexpected condition has occurred. The GUI display 350 may vary and the foregoing is intended merely as an example.

Table 2 shows toner level and corresponding visual elements in the GUI display 350.

TABLE 2

| Toner Remaining | | User Interface | | |
|---|---|---|---|---|
| Actual (from toner sensor) | Estimated | Lock | Synthetic Toner Level | Arrow |
| 100 | | Yes | 100 | No |
| 90 | | Yes | 90 | No |
| 80 | | Yes | 80 | No |
| 70 | | Yes | 70 | No |
| 60 | | Yes | 60 | No |
| 50 | | Yes | 50 | No |
| 40 | | Yes | 40 | No |
| 30 | | Yes | 30 | No |
| 20 | | Yes | 20 | No |
| | 19 | Yes | 20 | No |
| | 18 | Yes | 20 | No |
| | 17 | Yes | 20 | No |
| | 16 | Yes | 20 | No |
| | 15 | Yes | 20 | No |
| | 14 | Yes | 10 | No |
| | 13 | Yes | 10 | No |
| | 12 | Yes | 10 | No |
| | 11 | Yes | 10 | No |
| | 10 | Yes | 10 | No |
| | 9 | Yes | 10 | No |
| | 8 | Yes | 10 | No |
| | 7 | Yes | 10 | No |
| | 6 | Yes | 10 | No |
| | 5 | Yes | 10 | No |
| | 4 | Yes | 10 | No |
| | 3 | Yes | 10 | No |
| | 2 | Yes | 10 | No |
| | 1 | Yes | 10 | No |
| | 0 | Yes | 10 | No |
| | −1 | Yes | 10 | No |
| 10 (near end) | | No | 5 | No |
| 0 (toner end) | | No | 0 | Yes |

The first column includes sensor data from the toner sensor. The sensor data includes actual toner levels of the toner cartridge at specific, known increments. The second column includes calculated data based on the sensor data from the toner sensor. The calculated data includes estimated toner levels of the toner cartridge. The fourth column includes mapped data associated with the actual and estimated toner levels of the toner cartridge. The mapped data includes synthetic toner levels of the toner cartridge that are visually displayed on the GUI display 350.

Using the foregoing techniques, synthetic toner levels may be determined from actual and estimated toner levels of a tone cartridge of a printing device. Previously, printing devices display a default toner level once that toner level is reached and for each subsequent toner level, which was unavailable to users. Users often replace toner cartridges once the default toner level is displayed, even though there is capacity for additional printing. The synthetic toner levels may override the default toner level and may be displayed on a GUI of the printing device to inform users of printing capacity. Thus, the approaches disclosed herein maximizes use of a toner cartridge.

V. Implementation Examples

According to one embodiment, the techniques described herein are implemented by at least one computing device. The techniques may be implemented in whole or in part using a combination of at least one server computer and/or other computing devices that are coupled using a network, such as a packet data network. The computing devices may be hard-wired to perform the techniques, or may include digital electronic devices such as at least one application-specific integrated circuit (ASIC) or field programmable gate array (FPGA) that are persistently programmed to perform the techniques, or may include at least one general purpose hardware processor programmed to perform the techniques pursuant to program instructions in firmware, memory, other storage, or a combination. Such computing devices may also combine custom hard-wired logic, ASICs, or FPGAs with custom programming to accomplish the described techniques. The computing devices may be server computers, workstations, personal computers, portable computer systems, handheld devices, mobile computing devices, wearable devices, body mounted or implantable devices, smartphones, smart appliances, internetworking devices, autonomous or semi-autonomous devices such as robots or unmanned ground or aerial vehicles, any other electronic device that incorporates hard-wired and/or program logic to implement the described techniques, one or more virtual computing machines or instances in a data center, and/or a network of server computers and/or personal computers.

Figure 4:
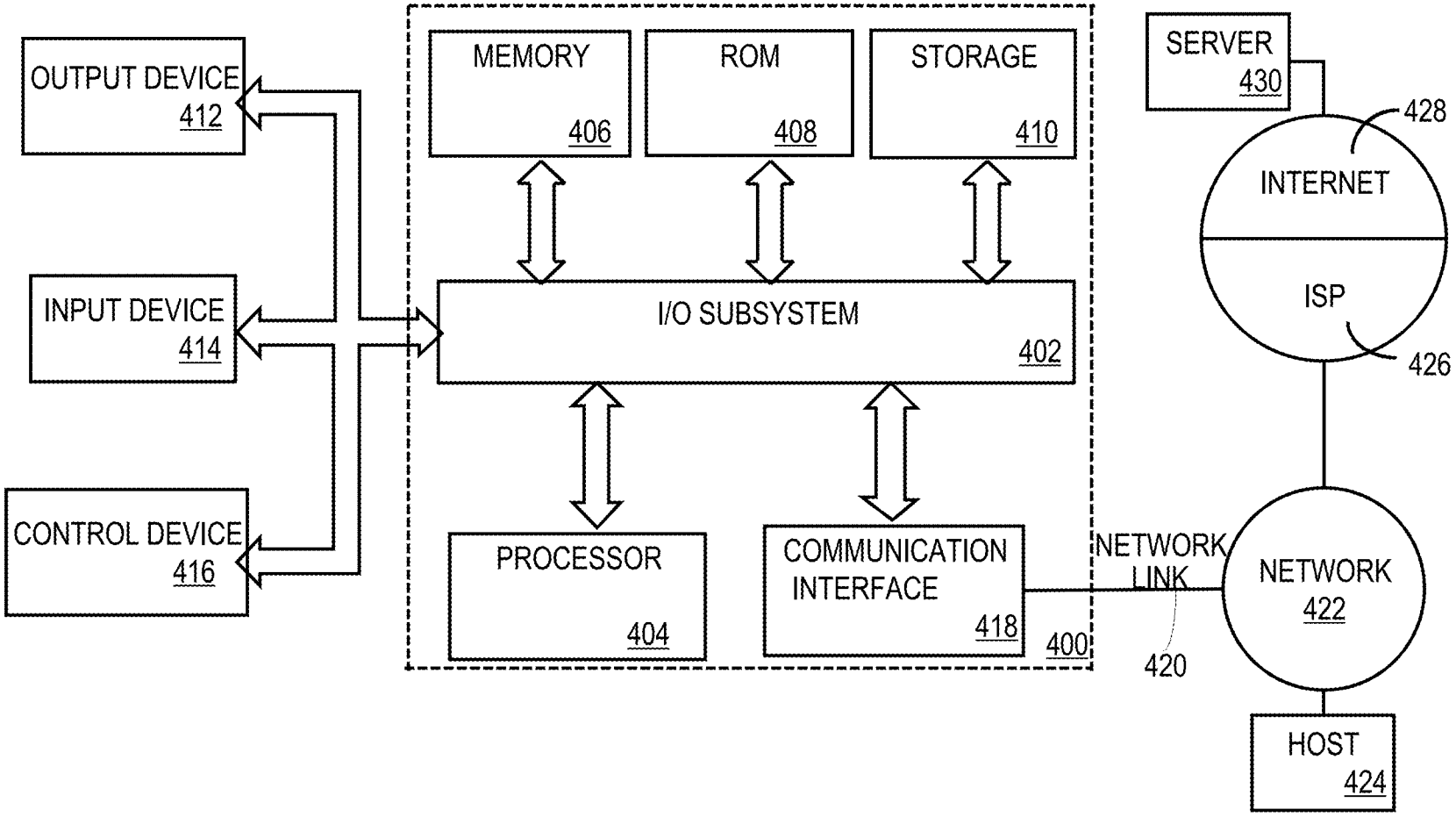
FIG. 4 is a block diagram of a computer system on which embodiments may be implemented.

FIG. 4 is a block diagram that illustrates an example computer system with which an embodiment may be implemented. In the example of FIG. 4, a computer system 400 and instructions for implementing the disclosed technologies in hardware, software, or a combination of hardware and software, are represented schematically, for example as boxes and circles, at the same level of detail that is commonly used by persons of ordinary skill in the art to which this disclosure pertains for communicating about computer architecture and computer systems implementations.

Computer system 400 includes an input/output (I/O) subsystem 402 which may include a bus and/or other communication mechanism(s) for communicating information and/or instructions between the components of the computer system 400 over electronic signal paths. The I/O subsystem 402 may include an I/O controller, a memory controller and at least one I/O port. The electronic signal paths are represented schematically in the drawings, for example as lines, unidirectional arrows, or bidirectional arrows.

At least one hardware processor 404 is coupled to I/O subsystem 402 for processing information and instructions. Hardware processor 404 may include, for example, a general-purpose microprocessor or microcontroller and/or a special-purpose microprocessor such as an embedded system or a graphics processing unit (GPU) or a digital signal processor or ARM processor. Processor 404 may comprise an integrated arithmetic logic unit (ALU) or may be coupled to a separate ALU.

Computer system 400 includes one or more units of memory 406, such as a main memory, which is coupled to I/O subsystem 402 for electronically digitally storing data and instructions to be executed by processor 404. Memory 406 may include volatile memory such as various forms of random-access memory (RAM) or other dynamic storage device. Memory 406 also may be used for storing temporary variables or other intermediate information during execution of instructions to be executed by processor 404. Such instructions, when stored in non-transitory computer-readable storage media accessible to processor 404, can render computer system 400 into a special-purpose machine that is customized to perform the operations specified in the instructions.

Computer system 400 further includes non-volatile memory such as read only memory (ROM) 408 or other static storage device coupled to I/O subsystem 402 for storing information and instructions for processor 404. The ROM 408 may include various forms of programmable ROM (PROM) such as erasable PROM (EPROM) or electrically erasable PROM (EEPROM). A unit of persistent storage 410 may include various forms of non-volatile RAM (NVRAM), such as FLASH memory, or solid-state storage, magnetic disk or optical disk such as CD-ROM or DVD-ROM, and may be coupled to I/O subsystem 402 for storing information and instructions. Storage 410 is an example of a non-transitory computer-readable medium that may be used to store instructions and data which when executed by the processor 404 cause performing computer-implemented methods to execute the techniques herein.

The instructions in memory 406, ROM 408 or storage 410 may comprise one or more sets of instructions that are organized as modules, methods, objects, functions, routines, or calls. The instructions may be organized as one or more computer programs, operating system services, or application programs including mobile apps. The instructions may comprise an operating system and/or system software; one or more libraries to support multimedia, programming or other functions; data protocol instructions or stacks to implement TCP/IP, HTTP or other communication protocols; file format processing instructions to parse or render files coded using HTML, XML, JPEG, MPEG or PNG; user interface instructions to render or interpret commands for a graphical user interface (GUI), command-line interface or text user interface; application software such as an office suite, internet access applications, design and manufacturing applications, graphics applications, audio applications, software engineering applications, educational applications, games or miscellaneous applications. The instructions may implement a web server, web application server or web client. The instructions may be organized as a presentation layer, application layer and data storage layer such as a relational database system using structured query language (SQL) or no SQL, an object store, a graph database, a flat file system or other data storage.

Computer system 400 may be coupled via I/O subsystem 402 to at least one output device 412. In one embodiment, output device 412 is a digital computer display. Examples of a display that may be used in various embodiments include a touch screen display or a light-emitting diode (LED) display or a liquid crystal display (LCD) or an e-paper display. Computer system 400 may include other type(s) of output devices 412, alternatively or in addition to a display device. Examples of other output devices 412 include printers, ticket printers, plotters, projectors, sound cards or video cards, speakers, buzzers or piezoelectric devices or other audible devices, lamps or LED or LCD indicators, haptic devices, actuators or servos.

At least one input device 414 is coupled to I/O subsystem 402 for communicating signals, data, command selections or gestures to processor 404. Examples of input devices 414 include touch screens, microphones, still and video digital cameras, alphanumeric and other keys, keypads, keyboards, graphics tablets, image scanners, joysticks, clocks, switches, buttons, dials, slides, and/or various types of sensors such as force sensors, motion sensors, heat sensors, accelerometers, gyroscopes, and inertial measurement unit (IMU) sensors and/or various types of transceivers such as wireless, such as cellular or Wi-Fi, radio frequency (RF) or infrared (IR) transceivers and Global Positioning System (GPS) transceivers.

Another type of input device is a control device 416, which may perform cursor control or other automated control functions such as navigation in a graphical interface on a display screen, alternatively or in addition to input functions. Control device 416 may be a touchpad, a mouse, a trackball, or cursor direction keys for communicating direction information and command selections to processor 404 and for controlling cursor movement on display 412. The input device may have at least two degrees of freedom in two axes, a first axis (e.g., x) and a second axis (e.g., y), that allows the device to specify positions in a plane. Another type of input device is a wired, wireless, or optical control device such as a joystick, wand, console, steering wheel, pedal, gearshift mechanism or other type of control device. An input device 414 may include a combination of multiple different input devices, such as a video camera and a depth sensor.

In another embodiment, computer system 400 may comprise an internet of things (IoT) device in which one or more of the output device 412, input device 414, and control device 416 are omitted. Or, in such an embodiment, the input device 414 may comprise one or more cameras, motion detectors, thermometers, microphones, seismic detectors, other sensors or detectors, measurement devices or encoders and the output device 412 may comprise a special-purpose display such as a single-line LED or LCD display, one or more indicators, a display panel, a meter, a valve, a solenoid, an actuator or a servo.

When computer system 400 is a mobile computing device, input device 414 may comprise a global positioning system (GPS) receiver coupled to a GPS module that is capable of triangulating to a plurality of GPS satellites, determining and generating geo-location or position data such as latitude-longitude values for a geophysical location of the computer system 400. Output device 412 may include hardware, software, firmware and interfaces for generating position reporting packets, notifications, pulse or heartbeat signals, or other recurring data transmissions that specify a position of the computer system 400, alone or in combination with other application-specific data, directed toward host 424 or server 430.

Computer system 400 may implement the techniques described herein using customized hard-wired logic, at least one ASIC or FPGA, firmware and/or program instructions or logic which when loaded and used or executed in combination with the computer system causes or programs the computer system to operate as a special-purpose machine. According to one embodiment, the techniques herein are performed by computer system 400 in response to processor 404 executing at least one sequence of at least one instruction contained in main memory 406. Such instructions may be read into main memory 406 from another storage medium, such as storage 410. Execution of the sequences of instructions contained in main memory 406 causes processor 404 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage 410. Volatile media includes dynamic memory, such as memory 406. Common forms of storage media include, for example, a hard disk, solid state drive, flash drive, magnetic data storage medium, any optical or physical data storage medium, memory chip, or the like.

Storage media is distinct from but may be used in conjunction with transmission media. Transmission media participates in transferring information between storage media. For example, transmission media includes coaxial cables, copper wire and fiber optics, including the wires that comprise a bus of I/O subsystem 402. Transmission media can also take the form of acoustic or light waves, such as those generated during radio-wave and infra-red data communications.

Various forms of media may be involved in carrying at least one sequence of at least one instruction to processor 404 for execution. For example, the instructions may initially be carried on a magnetic disk or solid-state drive of a remote computer. The remote computer can load the instructions into its dynamic memory and send the instructions over a communication link such as a fiber optic or coaxial cable or telephone line using a modem. A modem or router local to computer system 400 can receive the data on the communication link and convert the data to a format that can be read by computer system 400. For instance, a receiver such as a radio frequency antenna or an infrared detector can receive the data carried in a wireless or optical signal and appropriate circuitry can provide the data to I/O subsystem 402 such as place the data on a bus. I/O subsystem 402 carries the data to memory 406, from which processor 404 retrieves and executes the instructions. The instructions received by memory 406 may optionally be stored on storage 410 either before or after execution by processor 404.

Computer system 400 also includes a communication interface 418 coupled to bus 402. Communication interface 418 provides a two-way data communication coupling to network link(s) 420 that are directly or indirectly connected to at least one communication networks, such as a network 422 or a public or private cloud on the Internet. For example, communication interface 418 may be an Ethernet networking interface, integrated-services digital network (ISDN) card, cable modem, satellite modem, or a modem to provide a data communication connection to a corresponding type of communications line, for example an Ethernet cable or a metal cable of any kind or a fiber-optic line or a telephone line. Network 422 broadly represents a local area network (LAN), wide-area network (WAN), campus network, internetwork or any combination thereof. Communication interface 418 may comprise a LAN card to provide a data communication connection to a compatible LAN, or a cellular radiotelephone interface that is wired to send or receive cellular data according to cellular radiotelephone wireless networking standards, or a satellite radio interface that is wired to send or receive digital data according to satellite wireless networking standards. In any such implementation, communication interface 418 sends and receives electrical, electromagnetic or optical signals over signal paths that carry digital data streams representing various types of information.

Network link 420 typically provides electrical, electromagnetic, or optical data communication directly or through at least one network to other data devices, using, for example, satellite, cellular, Wi-Fi, or Bluetooth technology. For example, network link 420 may provide a connection through a network 422 to a host computer 424.

Furthermore, network link 420 may provide a connection through network 422 or to other computing devices via internetworking devices and/or computers that are operated by an Internet Service Provider (ISP) 426. ISP 426 provides data communication services through a world-wide packet data communication network represented as internet 428. A server computer 430 may be coupled to internet 428. Server 430 broadly represents any computer, data center, virtual machine or virtual computing instance with or without a hypervisor, or computer executing a containerized program system such as DOCKER or KUBERNETES. Server 430 may represent an electronic digital service that is implemented using more than one computer or instance and that is accessed and used by transmitting web services requests, uniform resource locator (URL) strings with parameters in HTTP payloads, API calls, app services calls, or other service calls. Computer system 400 and server 430 may form elements of a distributed computing system that includes other computers, a processing cluster, server farm or other organization of computers that cooperate to perform tasks or execute applications or services. Server 430 may comprise one or more sets of instructions that are organized as modules, methods, objects, functions, routines, or calls. The instructions may be organized as one or more computer programs, operating system services, or application programs including mobile apps. The instructions may comprise an operating system and/or system software; one or more libraries to support multimedia, programming or other functions; data protocol instructions or stacks to implement TCP/IP, HTTP or other communication protocols; file format processing instructions to parse or render files coded using HTML, XML, JPEG, MPEG or PNG; user interface instructions to render or interpret commands for a graphical user interface (GUI), command-line interface or text user interface; application software such as an office suite, internet access applications, design and manufacturing applications, graphics applications, audio applications, software engineering applications, educational applications, games or miscellaneous applications. Server 430 may comprise a web application server that hosts a presentation layer, application layer and data storage layer such as a relational database system using structured query language (SQL) or no SQL, an object store, a graph database, a flat file system or other data storage.

Computer system 400 can send messages and receive data and instructions, including program code, through the network(s), network link 420 and communication interface 418. In the Internet example, a server 430 might transmit a requested code for an application program through Internet 428, ISP 426, local network 422 and communication interface 418. The received code may be executed by processor 404 as it is received, and/or stored in storage 410, or other non-volatile storage for later execution.

The execution of instructions as described in this section may implement a process in the form of an instance of a computer program that is being executed, and consisting of program code and its current activity. Depending on the operating system (OS), a process may be made up of multiple threads of execution that execute instructions concurrently. In this context, a computer program is a passive collection of instructions, while a process may be the actual execution of those instructions. Several processes may be associated with the same program; for example, opening up several instances of the same program often means more than one process is being executed. Multitasking may be implemented to allow multiple processes to share processor 404. While each processor 404 or core of the processor executes a single task at a time, computer system 400 may be programmed to implement multitasking to allow each processor to switch between tasks that are being executed without having to wait for each task to finish. In an embodiment, switches may be performed when tasks perform input/output operations, when a task indicates that it can be switched, or on hardware interrupts. Time-sharing may be implemented to allow fast response for interactive user applications by rapidly performing context switches to provide the appearance of concurrent execution of multiple processes simultaneously. In an embodiment, for security and reliability, an operating system may prevent direct communication between independent processes, providing strictly mediated and controlled inter-process communication functionality.

What is claimed is:

1. A printing device comprising:

a user interface configured to exchange information between one or more users and the printing device;

a toner cartridge;

at least one sensor configured to detect a first threshold level and a second threshold level that is below the first threshold level, wherein an amount of toner left in the toner cartridge that is at or below the second threshold level is associated with the same default toner level;

one or more print processes configured to:

monitor a print usage of the printing device when a current toner level of the toner cartridge is between the first threshold level and the second threshold level that is below the first threshold level;

determine a first estimated toner level of the current toner level of the toner cartridge when the current toner level of the toner cartridge is below the second threshold level, wherein the first estimated toner level is determined based on:

the print usage of the printing device that was monitored when the current toner level of the toner cartridge was between the first threshold level and the second threshold level that is below the first threshold level, a number of pages printed since the second threshold level, the first threshold level, and the second threshold level; and override a visual indication of the default toner level with a visual indication of the first estimated toner level of the toner cartridge on the user interface to provide finer granularity of the current toner level that is otherwise unavailable from a display of the visual indication of the default toner level.

2. The printing device of claim 1, wherein the visual indication of the first estimated toner level of the toner cartridge is displayed when a number of pages printed is in a range associated with the first estimated toner level.

3. The printing device of claim 1, wherein the visual indication of the first estimated toner level of the toner cartridge includes one or more of a percentage of toner remaining in the toner cartridge or a number of remaining pages that can be printed.

4. The printing device of claim 1, wherein the one or more print processes are further configured to:

monitor a subsequent print usage between the first estimated toner level of the toner cartridge and a second estimated toner level of the toner cartridge that is below the first estimated toner level of the toner cartridge;

determine accuracy of a third estimated toner level that is below the second estimated toner level of the toner cartridge based on the subsequent print usage, the first estimated toner level and the second estimated toner level.

5. The printing device of claim 1, wherein the one or more print processes are further configured to determine whether the current toner level is at a third threshold level that is below the second threshold level.

6. The printing device of claim 5, wherein the one or more print processes are further configured to display a lock indicator for the toner cartridge when the current toner level is not yet at the third threshold level, and is configured to not to display the lock indicator for the toner cartridge when the current toner level is at the third threshold level.

7. The printing device of claim 5, further comprising a network interface for communicatively coupling the printing device to a network, and wherein the one or more print processes are further configured to transmit an electronic notification to a remote device via the network interface when the current toner level is at the third threshold level.

8. The printing device of claim 5, wherein the one or more print processes are further configured to receive configuration data from a remote device and to configure the third threshold level based on the configuration data.

9. A one or more non-transitory computer-readable media storing instructions which, when processed by one or more processors, cause:

monitoring, by a printing device, a print usage of the printing device when a current toner level of a toner cartridge is between a first threshold level and a second threshold level that is below the first threshold level, wherein the first threshold level and the second threshold level are detected by at least one sensor of the printing device, wherein an amount of toner left in the toner cartridge that is at or below the second threshold level is associated with the same default toner level;

determining, by the printing device, a first estimated toner level of the current toner level of the toner cartridge when the current toner level of the toner cartridge is below the second threshold level, wherein the first estimated toner level is determined based on:

the print usage of the printing device that was monitored when the current toner level of the toner cartridge was between the first threshold level and the second threshold level that is below the first threshold level, a number of pages printed since the second threshold level, the first threshold level, and the second threshold level; and overriding, by the printing device, a visual indication of the default toner level with a visual indication of the first estimated toner level of the toner cartridge on a user interface to provide finer granularity of the current toner level that is otherwise unavailable from a display of the visual indication of the default toner level.

10. The one or more non-transitory computer-readable media of claim 9, wherein the visual indication of the first estimated toner level of the toner cartridge is displayed when a number of pages printed is in a range associated with the first estimated toner level.

11. The one or more non-transitory computer-readable media of claim 9, wherein the visual indication of the first estimated toner level of the toner cartridge includes one or more of a percentage of toner remaining in the toner cartridge or a number of remaining pages that can be printed.

12. The one or more non-transitory computer-readable media of claim 9, wherein the instructions which, when processed by the one or more processors, further cause:

monitoring, by the printing device, a subsequent print usage between the first estimated toner level of the toner cartridge and a second estimated toner level of the toner cartridge that is below the first estimated toner level of the toner cartridge;

determining, by the printing device, accuracy of a third estimated toner level that is below the second estimated toner level of the toner cartridge based on the subsequent print usage, the first estimated toner level and the second estimated toner level.

13. The one or more non-transitory computer-readable media of claim 9, wherein the instructions which, when processed by the one or more processors, further cause determining, by the printing device, whether the current toner level is at a third threshold level that is below the second threshold level.

14. The one or more non-transitory computer-readable media of claim 13, wherein the instructions which, when processed by the one or more processors, further cause displaying, by the printing device, a lock indicator for the toner cartridge only when the current toner level is not yet at the third threshold level.

15. The one or more non-transitory computer-readable media of claim 13, wherein the instructions which, when processed by the one or more processors, further cause transmitting, by the printing device, an electronic notification to a remote device via a network interface of the printing device when the current toner level is at the third threshold level.

16. The one or more non-transitory computer-readable media of claim 13, wherein the instructions which, when processed by the one or more processors, further cause receiving, by the printing device, configuration data from a remote device and configuring the third threshold level based on the configuration data.

17. A computer-implemented method comprising:

monitoring, by a printing device, a print usage of the printing device when a current toner level of a toner cartridge is between a first threshold level and a second threshold level that is below the first threshold level, wherein the first threshold level and the second threshold level are detected by at least one sensor of the printing device, wherein an amount of toner left in the toner cartridge that is at or below the second threshold level is associated with the same default toner level;

determining, by the printing device, a first estimated toner level of the current toner level of the toner cartridge when the current toner level of the toner cartridge is below the second threshold level, wherein the first estimated toner level is determined based on:

the print usage of the printing device that was monitored when the current toner level of the toner cartridge was between the first threshold level and the second threshold level that is below the first threshold level, a number of pages printed since the second threshold level, the first threshold level, and the second threshold level; and overriding, by the printing device, a visual indication of the default toner level with a visual indication of the first estimated toner level of the toner cartridge on a user interface to provide finer granularity of the current toner level that is otherwise unavailable from a display of the visual indication of the default toner level.

18. The computer-implemented method of claim 17, wherein the visual indication of the first estimated toner level of the toner cartridge is displayed when a number of pages printed is in a range associated with the first estimated toner level, and wherein the visual indication of the first estimated toner level of the toner cartridge includes one or more of a percentage of toner remaining in the toner cartridge or a number of remaining pages that can be printed.

19. The computer-implemented method of claim 17, further comprising:

monitoring, by the printing device, a subsequent print usage between the first estimated toner level of the toner cartridge and a second estimated toner level of the toner cartridge that is below the first estimated toner level of the toner cartridge;

determining, by the printing device, accuracy of a third estimated toner level that is below the second estimated toner level of the toner cartridge based on the subsequent print usage, the first estimated toner level and the second estimated toner level.

20. The computer-implemented method of claim 17, further comprising:

determining, by the printing device, whether the current toner level is at a third threshold level that is below the second threshold level;

transmitting, by the printing device, an electronic notification to a remote device via a network interface of the printing device when the current toner level is at the third threshold level.

* * * * *